United States Patent [19]

Blum et al.

[11] 4,381,942

[45] May 3, 1983

[54] PROCESS FOR THE PRODUCTION OF TITANIUM-BASED ALLOY MEMBERS BY POWDER METALLURGY

[75] Inventors: Pierre Blum, Grenoble; Jacques Devillard, Saint Ismier, both of France

[73] Assignee: Commissariat a l'Energie Atomique, Paris, France

[21] Appl. No.: 180,503

[22] Filed: Aug. 22, 1980

[30] Foreign Application Priority Data

Aug. 27, 1979 [FR] France ..... 79 21441

[51] Int. Cl.[3] ..... B22F 1/00; B22F 3/12

[52] U.S. Cl. ..... 419/23; 75/226; 75/245; 75/175.5; 419/35; 419/46; 419/49

[58] Field of Search ..... 75/212, 226, 245, 175.5

[56] References Cited

U.S. PATENT DOCUMENTS

| | | | |
|---|---|---|---|
| 3,341,325 | 9/1967 | Cloran | 75/212 |
| 3,953,205 | 4/1976 | Cox et al. | 75/226 |
| 3,963,485 | 6/1976 | Thellmann | 75/212 |

FOREIGN PATENT DOCUMENTS

| | | | |
|---|---|---|---|
| 989649 | 5/1976 | Canada | 75/212 |

*Primary Examiner*—Brooks H. Hunt

*Attorney, Agent, or Firm*—Michael N. Meller; Anthony H. Handal

[57] ABSTRACT

The invention relates to a process for the production of titanium-based alloy members by powder metallurgy.

This process consists of:

(a) preparing a titanium or titanium alloy powder having a grain size distribution between 100 and 1000 μm, (b) depositing on said powder a coating of a material such that on contact with the titanium or titanium alloy it forms a liquid phase at a temperature $T_1$ which is below the allotropic transformation temperature T of the titanium or titanium alloy constituting the said powder, (c) introducing the thus coated powder into a mould, and (d) hot compressing this powder in the mould at a pressure of 10 to 30 MPa at a temperature between $T_1$ and T for a time such that a complete densification of the powder is obtained.

Application to the construction of discs for turbines with integrated blades.

14 Claims, 1 Drawing Figure

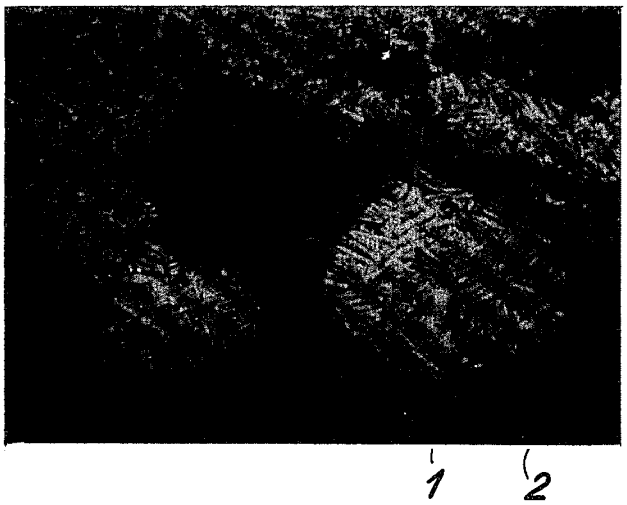
1
2

PROCESS FOR THE PRODUCTION OF TITANIUM-BASED ALLOY MEMBERS BY POWDER METALLURGY

BACKGROUND OF THE INVENTION

The present invention relates to a process for the production of titanium-based alloy members by powder metallurgy.

Hitherto the processes used for producing titanium or titanium alloy members have involved the use either of direct casting or of fritting.

Processes involving direct casting have the disadvantage of requiring an additional low temperature forging stage to obtain the $\alpha+\beta$ structure making it possible to give the members obtained a satisfactory resistance to cyclic fatigue.

Thus, it is known that titanium has an allotropic transformation at a temperature of 882° C., so that the latter defines the stability region of two phases. The two phases are the $\alpha$ phase with a compact hexagonal structure which is stable below 882° C. and the centred cubic $\beta$ phase which appears above 882° C.

In the case of titanium alloy the presence of certain addition elements lead to a two-phase $\alpha+\beta$ region which corresponds to a structure giving improved mechanical properties. However, to maintain this structure during the shaping operations it is necessary not to exceed the allotropic transformation temperature of the alloy, which varies as a function of the elements present in the latter. Most addition elements used in titanium alloys tend either to widen the existence region of the $\alpha$ phase or that of the $\beta$ phase. Moreover, certain elements such as aluminium are alphagenic elements which aid the formation of the $\alpha$ structure, whilst other elements such as vanadium, molybdenum, iron, chrome, manganese, niobium and copper are betagenic elements which aid the formation of the $\beta$ structure.

The processes for the production of titanium members using fritting generally consist of carrying out a hot isostatic fritting at a pressure of 1 to $1.5 \cdot 10^2$ MPa for four hours. This takes place at a temperature of approximately 950° C. when it is wished to maintain the $\alpha$ phase in the case of pure titanium or when it is wished to obtain the $\alpha+\beta$ structure in the case of titanium alloys or at a temperature of approximately 1050° C. on seeking the temperature range corresponding to the $\beta$ phase of pure titanium or of its alloys.

Such processes have the disadvantage of requiring high pressures and relatively long periods of time, which increases the cost of the members obtained.

When using powders of titanium or titanium alloy having a grain size above 100 $\mu$m it is impossible to obtain a satisfactory densification of the powder at pressures below $1 \cdot 10^2$ MPa, because the hot plasticity of the titanium is inadequate to obtain a satisfactory deformation of such powders.

However, it is possible to produce titanium or titanium alloy members by conventional fritting processes at pressures below 50 MPa and temperatures below 900° C. when using kneaded and ground titanium or titanium alloy powders. However, in this case the members obtained are brittle due to a significant oxygen intergranular contamination.

U.S. Pat. No. 3,963,485 also discloses a process for producing titanium members by powder metallurgy in which a mixture of titanium powder and iron-coated titanium powder is used to improve the ductility of the members obtained.

However, this process is not suitable for obtaining a satisfactory densification, particularly in the case of difficultly deformable titanium alloy powders.

In addition, fritting processes do not make it possible to directly obtain members with a complex shape such as the discs of turbines having integrated blades and which specifically have a "ring" structure, i.e. a heterogenic structure characterized by the presence of large grains which are surrounded and welded together by finely crystallized grains.

BRIEF SUMMARY OF THE INVENTION

The present invention relates to a process for the production of titanium-based alloy members by powder metallurgy, which obviates the disadvantages of the aforementioned processes and which makes it possible to obtain titanium alloy members having a "ring" structure.

This process is characterized in that it comprises:

(a) preparing a titanium or titanium alloy powder having a grain size distribution between 100 and 1000 $\mu$m, (b) depositing on said powder a coating formed from a material such that in contact with the titanium or titanium alloy it can form a liquid phase at a temperature $T_1$ below the allotropic transformation temperature T of the titanium or titanium alloy constituting the said powder, (c) introducing the coated powder into a mould, and (d) hot compressing the powder in the mould under a pressure of 10 to 30 MPa and at a temperature between $T_1$ and T for a time such that a complete densification of the powder is obtained.

The process as defined hereinbefore advantageously utilizes the fact that by locally modifying the surface composition of the titanium or titanium alloy powder particles by coating with an appropriate material such as copper during fritting an interstitial liquid phase appears on the surface of the powder grains, thus facilitating local deformations. This makes it possible to carry out fritting at temperatures and pressures below those which are conventionally necessary for fritting powders with a grain size between 100 and 1000 $\mu$m.

Thus, bearing in mind the dimensions of the powder grains the coating material which, in the case of copper generally represents 1 to 5% by weight, only affects the cortical zone of the grains, without profoundly modifying the composition of the alloy. Furthermore, during heating the compression exerted during the temperature rise, i.e. when the coating material is still present on the surface of the grains, makes it possible to obtain a local deformation of the latter and also their densification.

According to the invention the coating material can be constituted by a titanium compound which is fusible at temperature $T_1$, or preferably a material containing an element able to combine with the titanium of the powder to form a compound, for example a eutectic, which is fusible at temperature $T_1$. In the latter case the coating can be constituted by said element or by a compound or alloy thereof.

Preferably the element used for forming the coating is a betagenic element such as iron, copper or nickel. Preferably copper is used.

Thus, it is possible to improve the fritting kinetics by modifying the phases of the alloy during densification.

Titanium alloys of the $TA_6V$ type, i.e. alloys containing 90% titanium, 6% aluminium and 4% vanadium, with no addition of betagenic elements such as copper have a two-phase structure ($\alpha+\beta$) in the temperature range 900° to 980° C. used for fritting. However, this two-phase structure ($\alpha+\beta$) has a high deformation resistance, which is not favourable to densification. However, on coating the powder grains with a betagenic element such as copper, it is possible to modify the phase equilibrium by locally forming a monophase $\beta$ structure having a considerable deformation tendency and thus aiding fritting. However, during densification and after formation of the liquid phase the betagenic element tends to diffuse towards the centre of the grains. To locally obtain this monophase $\beta$ structure which aids fritting on the surface of the grains it is advantageous to carry out heating and pressure application sufficiently rapidly to prevent too great a diffusion of the betagenic element and locally obtain an adequate concentration thereof.

Preferably the powder is heated to the fritting temperature at a speed of approximately 500° to 1000° C./h. Finally the process according to the invention has the advantage of leading to titanium alloy members having improved mechanical properties. Through carrying out fritting under the aforementioned conditions it is possible to obtain titanium alloy members having a so-called "ring" structure, i.e. a heterogenic structure characterized by the presence of large grains having a two-phase structure ($\alpha+\beta$), which are surrounded and welded to one another by a phase having an ex$\beta$ structure with fine $\alpha$ precipitation of the WIDMANSTATTEN type, which is resistant to crack propagation. The fineness of the $\alpha$ precipitation is in particular dependent on the speed at which the members obtained are cooled.

According to a preferred embodiment of the inventive process the titanium or titanium alloy powder with a grain size of 100 to 1000 $\mu$m is prepared by a fusion-centrifuging method.

It is pointed out that this method consists of heating to the fusion or melting temperature the end surface of a cylindrical titanium or titanium alloy ingot rotated about its axis. Thus, under the action of the centrifugal force the molten titanium or titanium alloy is ejected from the end surface of the ingot in the form of liquid droplets which, on cooling are transformed by solidification into spherical particles, most of which have a diameter between 100 and 1000 $\mu$m.

Preferably a titanium powder with particles of diameter between 100 and 600 $\mu$m is used for the process of the invention.

Moreover, when using this fusion-centrifuging method for preparing the initial powder it is preferable to subject it to a surface treatment before depositing the coating material on the latter. This surface treatment can consist of degreasing carried out, for example, by immersing the powder in pure trichloroethylene and then rinsing the latter with methanol.

When the initial powder is obtained from a titanium alloy containing an alphagenic element such as aluminium this surface treatment is preferably a treatment for eliminating the surface coating which is rich in alphagenic element and which may be present on certain particles.

When ally powders of this type are prepared by the fusion-centrifuging method during the cooling of the liquid alloy droplets there is sometimes a surface enrichment of the powder particles by alphagenic element, which is undesirable for obtaining good mechanical properties because, after fritting, said alphagenic element-rich coatings may persist in the fritted member and then may aid crack propagation therein.

In the case of an alloy containing aluminium the aluminium-rich surface layer can be eliminated from the powder particles by immersing the latter in a sodium carbonate solution kept at a temperature of approximately 60° to 70° C. and by then successively rinsing the particles with water, acetic acid and water.

According to the invention the coating is deposited on the titanium or titanium alloy powder by conventional methods. When the coating is constituted by an element such as iron, copper or nickel or by compounds such as nickel-phosphorus or iron-phosphorus chemical deposition methods are in particular used. When the coating material is copper deposition is advantageously carried out by electrochemical displacement of the copper from a solution using, for example, a solution constituted by a mixture of a first solution containing copper sulphate, methanol and formaldehide and a second solution containing soda and sodium potassium tartrate.

Preferably the coating operation is carried out at ambient temperature to prevent titanium oxidation.

Advantageously the thickness of the coating is a few microns, e.g. 1 to 5 $\mu$m.

For the compression operation the coated powder is placed in a mould and is then subject to uniaxial compression, whilst maintaining the mould at a temperature between $T_1$ and T.

The pressure exerted on the powder is between 10 and 30 MPa and this compression lasts until a complete densification of the powder is obtained. Generally this takes more than 1 hour, whilst approximately 2 hours is adequate to achieve this result.

DESCRIPTION OF THE DRAWING AND PREFERRED EMBODIMENTS

The invention will be better understood from reading the following exemplified description, with reference to the attached drawing which is a micrograph showing the structure of a titanium alloy member obtained by the process of the invention.

This embodiment relates to the preparation of a titanium alloy member from a titanium alloy powder ($TA_6V$), said alloy containing 90% titanium, 6% aluminum and 4% vanadium.

Spherical particles with a diameter between 315 and 630 $\mu$m are prepared from an ingot of this alloy by fusion-centrifuging.

The thus obtained sperical particles then undergo a preliminary treatment in order to eliminate the aluminium-rich surface layer from the powder particles. To this end the particles are immersed in a 50 g/liter solutionof sodium carbonate kept at a temperature of approximately 60°-70° C., working with 150 g particle fractions for 2 liters of solution. Following immersion the particles are rinsed with water and then the sodium carbonate is completely eliminated by immersing the particles in 2 liters of 5% acetic acid and by then rinsing them twice in water.

Following this preliminary treatment a copper coating is deposited on the particles by chemical displacement of the copper in solution. A coppering solution obtained by mixing 1 volume of an aqueous solution containing 10 g/l of $CuSO_4$, $5H_2O$, 300 ml/l of methanol and 60 ml/l of formaldehyde and 1 volume of a solution containing 40 g/liter of NaOH and 28 g/liter of Rochelle salt (sodium potassium tartrate) is used.

To form the coating 150 g of powder particles are immersed in 2 liters of solution at ambient temperature and the particles are left in the solution until the latter is completely decolourized, i.e. up to the time where the reduction of the coppering solution is complete. This operation lasts 3 to 4 days and every so often the particles immersed in the solution are shaken to obtain a homogeneous deposit. The particles are then rinsed with water, followed by ethanol and are then dried at 60° C.

The thus coated particles contain approximately 1.7% by weight of copper and the coating thickness of each particle is approximately 1 to 5 μm.

The coated particles are then placed in an alumina mould obtained by lost wax or hot casting. The upper part of the mould has a cylindrical feeder making it possible to add a supplementary quantity of particles to the upper part of the mould.

The mould is then placed within a heating device by interposing between the mould walls and the device a refractory metal powder having a low fritting capacity at the temperature chosen for the fritting process.

The mould containing the powder is then heated to a temperature of approximately 950° C. and the mould is maintained at this temperature under a maximum uniaxial pressure of 30 MPa for a time of approximately 2 hours, which ensures complete densification of the powder.

The compression of the powder during fritting is brought about by means of a plunger made from refractory material, which is placed in the upper part of the mould and can slide in the cylindrical feeder in order to feed into the mould the supplementary quantity of powder initially placed in the feeder, thus contributing to the elimination of the porosity in the firtted member.

After removing from the mould the members obtained have a "ring" structure, such as that shown in the drawing and corresponding to the presence of large grains (1) having the structure $(\alpha+\beta)$ surrounded by a phase (2) of structure ex$\beta$ with a fine $\alpha$ precipitation. It should also be noted that the microhardness variations are insignificant.

The attached table I shows the mechanical properties of breaking strength R, 0.2% yield point, elongation A (in %) and striction of the thus obtained member.

For comparison purposes this table gives the mechanical properties of members obtained according to the prior art, i.e. by isostatic fritting at 960° C. and $10^2$ MPa for four hours of a powder not coated with copper having the same grain size distribution, or by uniaxial fritting at 950° C. at 30 MPa for two hours of a kneaded and ground powder of the same alloy. In addition, this table also shows the characteristics corresponding to standard Air P 63.

The table shows that the process of the invention leads to improvements in the mechanical properties of the members obtained.

Moreover, oligocyclic fatigue resistance tests show that titanium alloys fritted by uniaxial compression at 950° C. and at between 10 and 30 MPa have properties identical to those of cast, forged alloys. For example after repeated stressing at 1 Hz between 8 and 80 MPa and 20° C. the life up to breaking is $10^5$ cycles for a fritted $TA_6V$ alloy with additions of copper at 950° C./30 MPa and $10^4$ cycles only for the same $TA_6V$ alloy without addition and fritted by isostatic compression at 950° C./$10^2$ MPa.

Moreover, it should be noted that when the members obtained according to the above example undergo thermal annealing treatment at 700° C. for two hours their tension characteristics are not modified. Thus, optimum properties are immediately obtained.

Finally the members obtained according to the process of the invention have a satisfactory behaviour on welding, which is not the case with members obtained by the prior art processes.

TABLE I

| Properties | Breaking Resistance R (10 MPa) | Yield point $R_{0.2}$ (10 MPa) | Elongation A % | Striction ε |
|---|---|---|---|---|
| Standard Air P 63 | 90 | 83 | 10 | 25 |
| Members obtained by isostatic fritting at 950° C. and $10^2$ MPa for four hours | 95 | 89 | 13/15 | 25 |
| Members obtained by uniaxial fritting of kneaded and ground powder at 950° C. at 30 MPa for two hours | 100 | 90 | 5 | 0 |
| Members obtained according to the invention | 103 | 95 | 13 | 32/25 |

What is claimed is:

1. A process for the production of titanium based alloy members, comprising:
   (a) preparing a metal powder selected from the group consisting of titanium and titanium alloys having a grain size distribution between 100 and 1000 μm,
   (b) depositing on said powder a coating formed from a material that in contact with said titanium powder can form a liquid phase at a temperature $T_1$, which is below the allotropic transformation temperature T of said powder,
   (c) introducing the coated powder into a mould, and
   (d) hot compressing the powder in the mould under a pressure of 10 to 30 MPa and at a temperature between $T_1$ and T for a time sufficient to obtain complete densification of the powder.

2. A process as in claim 1, wherein the coating material is a titanium compound fusible at a temperature $T_1$.

3. A process as in claim 1, wherein the coating material comprises an element which can combine with the titanium of the powder to form a compound fusible at a temperature $T_1$.

4. A process as in claim 3, wherein the element is a betagenic element.

5. A process as in claim 4, wherein the betagenic element is selected from the group consisting of nickel, iron and copper.

6. A process as in claim 1, wherein the powder is prepared by cooling liquid droplets of the metal obtained by melting of the end surface of a cylindrical ingot rotated about its axis.

7. A process as in claim 6, wherein the powder undergoes a surface treatment prior to the deposition of the coating.

8. A process as in claim 7, wherein the surface treatment consists of degreasing.

9. A process as in claim 7, wherein as the powder is a titanium alloy powder containing aluminum, the surface treatment serves to eliminate the outer aluminum-rich coating from the powder grains.

10. A process as in claim 1, wherein the particles have a diameter between 100 and 600 μm.

11. A process as in claim 3, wheren the coating material is copper.

12. A process as in claim 11, wherein the copper is deposited on the powder by chemical displacement from a solution.

13. A process as in claim 12, wherein said solution comprises a mixture of a first solution containing copper sulphate, methanol and formaldehyde and a second solution containing soda and sodium potassium tartrate.

14. A process as in claim 1, wherein the coating has a thickness of 1 to 5 μm.

* * * * *